United States Patent [19]

Hertrampf

[11] Patent Number: 4,733,983

[45] Date of Patent: Mar. 29, 1988

[54] DISPENSER TOOTHBRUSH

[76] Inventor: Michael Hertrampf, Schäfereiweg 7, 3007 Gehrden 1, Fed. Rep. of Germany

[21] Appl. No.: 838,451

[22] Filed: Mar. 11, 1986

[51] Int. Cl.[4] ..... A46B 11/02

[52] U.S. Cl. ..... 401/146; 401/149; 401/150; 401/171; 401/176; 401/178; 401/286; 222/105; 222/207; 222/385

[58] Field of Search ..... 401/150, 151, 156, 162, 401/169, 171, 176, 177, 179, 181, 184, 186, 286; 222/95, 105, 197, 207, 209, 377, 385

[56] References Cited

U.S. PATENT DOCUMENTS

| | | | |
|---|---|---|---|
| 2,033,197 | 3/1936 | Kinkade | 401/150 |
| 2,328,048 | 8/1943 | Bair | 401/150 |
| 2,587,794 | 3/1952 | Walker et al. | 401/286 |
| 3,227,165 | 1/1966 | Costanza | 401/178 |
| 4,088,412 | 5/1978 | Del Bon | 401/151 |

FOREIGN PATENT DOCUMENTS

| | | | |
|---|---|---|---|
| 929420 | 7/1947 | France | 401/286 |
| 2083142 A | 3/1982 | United Kingdom | 222/209 |

*Primary Examiner*—Richard J. Apley
*Assistant Examiner*—Franklin Gubernick
*Attorney, Agent, or Firm*—Allegretti, Newitt, Witcoff & McAndrews, Ltd.

[57] ABSTRACT

A fillable toothbrush provided with a handle containing a dispenser for toothpaste is disclosed. One end of the handle is provided with a stem through which a duct is provided from a storage chamber to an outlet adjacent to a brush arranged at the free end of the stem. An actuating element is provided at the end of the handle remote from the stem. When actuated, the actuating element moves a valve that closes off the storage chamber from the duct and pushes toothpaste through the duct to the brush. When the actuating element is released, the valve retracts and permits toothpaste in the storage chamber to flow into the duct. The dispenser toothbrush is of simple design and allows defined quantities of toothpaste to be dispensed in a reliable way.

45 Claims, 18 Drawing Figures

DISPENSER TOOTHBRUSH

BACKGROUND OF THE INVENTION

1. Field of the Invention

The present invention concerns a dispenser toothbrush.

2. Description of the Prior Art

A dispenser toothbrush is shown in West German Pat. Spec. No. DE-OS No. 26 30 569 that comprises a special spring-loaded valve body together with two valve faces and two valve seats. This type of design is relatively complex and also requires the use of an actuating element of very special design.

Toothbrushes are known from West German Pat. Specifications Nos. DE-PS 144 302 and DE-GMS 1 929 029 in which the end of the handle is provided with a rubber cap. This rubber cap can be squeezed such that pressure can be applied to the inside of a storage chamber. In this way, it is claimed that it is possible to squeeze the contents of th storage chamber through a duct towards an area adjacent to the bristles. However, no valves are provided and a measured supply cannot be provided in this way.

SUMMARY OF THE INVENTION

The purpose of the present invention is to avoid the disadvantages of the prior art dispenser toothbrushes and to provide a toothbrush of simple design with which measured quantities of toothpaste can be reliably dispensed.

The present invention provides a dispenser toothbrush having only a single valve. A pumping effect is nonetheless achieved. This pumping effect is associated with the flow resistance in the supply duct from the storage chamber to the supply outlet aperture. The pumping effect is also due to the fact that the valve of the means for altering the volume of the dispenser remains open when it is not actuated. Thus, there is essentially no resistance to the flow of toothpaste as it is supplied adjacent to the means for altering the volume. By contrast, the flow resistance in the duct from the storage chamber to the outlet will tend to prevent the return flow of the toothpaste. As soon as the means for altering the volume is actuated, the valve will close so that the toothpaste is supplied from the means for altering the volume through the duct to the outlet aperture. As soon as the means for altering the volume returns to its resting state, so that the volume between the valve and the duct increases, toothpaste will flow through the open valve to the area adjacent to the means for altering the volume. The flow of toothpaste returning from the duct, however, will be largely prevented on account of flow resistance. The design of the dispenser toothbrush is considerably simplified by the provision of only a single valve. As a result, an extraordinarily low production cost can be achieved.

The valve may be configured in a number of possible ways. The valve may be formed as a flap or disk that bears down on a suitable seat as the valve closes. In the closed state, the valve and the valve flap are unbiased so that they remain open under the effect of gravity when the dispenser toothbrush is stood upright on its stand, thus allowing a totally unimpeded flow of toothpaste through the dispenser.

The valve flap, disk or similar device, together with the cap sealing off the lower plate of the storage chamber, may consist of a single piece of flexible plastic material. This cap is simply pressed into the lower open part of the handle and serves to seal off the storage chamber. The cap constitutes the means for altering the volume at the same time. As the cap is squeezed, the volume of the space directly above it is reduced. The valve seat for the valve flap, disk or other similar device is formed quite simply by the lower edges of teh storage chamber. It is useful if the flap or disk extends essentially over the entire cross section of the lower part of the storage chamber. In this way, resistance to the flow of toothpaste will be particularly low. In addition, the valve flap or disk stroke can be kept relatively low on account of its large cross section.

Another type of valve arrangement is based on the basic concept of using a piston to form the valve. When the dispenser is actuated, the V-shaped lip seal is brought into inteimate contact with the winside wall of the cylinder, so that when it is moved, the entire lip seal acts like a solid piston. When this piston returns to rest, the V-shaped lip seal narrows so that a gap forms between the edges of the lip seal and the cylinder wall. Through this gap, toothpaste from the rear end of the lip seal can flow or be squeezed forwards in the direction of supply towards the front side of the lip seal. This process requires the prsence of a sufficient resistance to the flow of the toothpaste or cleaning agent. This resistance, which will always be present to some degree, will naturally depend on the viscosity of the toothpaste concerned. High flow resistance will exist particularly in the duct upstream of the lip seal and as far as the outlet aperture. Therefore, the level of flow resistance can be determined by sizing this duct suitably. If required, additional flow resistance can easily be set up by the provision of narrowed sections.

The lip seal may be arranged on a piston whose diameter is less than the diameter of the cylilnder, so as to provide a sufficient channel for the flow of the toothpaste or liquid cleaning agent on the return stroke of the piston. In a further embodiment of the present invention, which is especially useful, the V-shaped lip seal comprises the entire piston, whereby a piston rod extends from the tip of the V to the actuating element. The lip seal, the piston rod and the actuating element may all consist of a single plastic component, if necessary, which provides a design that can be produced extremely cheaply.

The actuating element may consist of a piston that can be moved up and down in a cylindrical aperture for filling the storage chamber of the dispenser. The actuating element is spring loaded outwards against the direction of actuation. In a particularly advantageous embodiment of the present invention, the actuating element takes the form of a convex elastic cap that can be operated by the finger. In this case, the piston and the return spring constitute a single component that can be simply made, if required, from a single piece of material together with the lip seal and the piston rod. In this case, the entire dispenser can be assembled from practically two components, namely one part forming the handle and the stem and the other part comprising the actuating element, the piston rod and the piston. In this way, the cost of the dispenser toothbrush can be kept so low that it will hardly exceed the cost of an ordinary toothbrush and a tube of toothpaste. The widespread introduction of dispenser toothbrushes of this type will in practice depend on the possibility of holding the price down to this level. Dispenser toothbrushes are desirable for medical reasons, since the dispenser capacity will be the factor that determines when the user throws the toothbrush away and replaces it after a defined period of use. In this way, the user is not tempted to use a toothbrush that is too worn, which is medically undesirable.

In a further embodiment of the present invention, portions of the handle, such as a flexible cap, project above the actuating element so as to protect the latter from being operated by mistake. The projecting parts, which may be tubular in shape, for example, may at the same time serve as a stand to support the dispenser toothbrush in a vertical position. This insures that the toothpaste remaining in the storage chamber will always flow down adjacent to the piston and cylinder arrangement and the storage chamber will consequently always be regularly emptied, no matter how much toothpaste is left in it. This is assisted by the presence of a ventilation hole arranged in the wall of the storage chamber. This ventilation hole may be very small, so as th prevent the escape of toothpaste, but it will be enough to prevent the occurrence of any underpressure that might possibly tend to inhibit the operation of the supply piston and cylinder arrangement.

In a further embodiment of the present invention, the piston and cylinder arrangement is reversed, so that the piston is fixed to the handle by means of a rather long supply tube. The supply tube thus serves as the piston rod, whereas the cylinder is attached to the actuating element. This embodiment of the present invention can be produced from simple components, such as an extended tube, a single lip seal that can be slipped over the tube to form the piston, and a simple cap-shaped cylinder arrangement that can be easily mounted on the actuating element or can even be formed as a part of it.

In order to insure that the diameter of the lip seal diminshes sufficiently on the piston return storke after actuation and allows toothpaste to flow past it, an appropriate choice of material for the lip seal must be made. The lip seal must be sufficiently elastic and flexible. The lip seal is V-shaped and as toothpaste is supplied, the front side of the seal is subjected to load. As a result, the shape of the edge of the lip seal will be altered as it comes to bear against the cylinder wall, being stretched to some extent. For this reason, in a further embodiment of the present invention, a lip seal is provided with an edge whose diamter is narrower than that of the corresponding cylinder, so as to facilitate the flow of toothpaste on the return stroke of the piston, following a supply stroke. This embodiment, however, requires the use of toothpaste of higher viscosity to insure that it does not leak, for example, when the toothbrush is laid down horizontally.

The lip seal may be symmetrical about an axis or may be elliptic. However, the lip seal may also have a cross section that will adopt a regular V-shape when it is extended at a right angle to the dirction of flow of toothpaste, thus forming a pair of opposite lips that fit inside a cylinder of square cross section. Unlike the cylindrical or elliptical configurations, these lips are not stressed when they are stretched or compressed, but rather are only subjected to shear stresses. Lip seals of this type will be especially flexible and toothpaste will flow past them very easily on the return storke of the lip seal following the working stroke.

Further objects and embodiments of the present invention will be made known in the following description of the preferred embodiments and claims.

BRIEF DESCRIPTION OF THE DRAWINGS

The present invention will now be elucidated with the help of the attached drawings, where.

DESCRIPTION OF THE PREFERRED EMBODIMENTS

Figure 1:
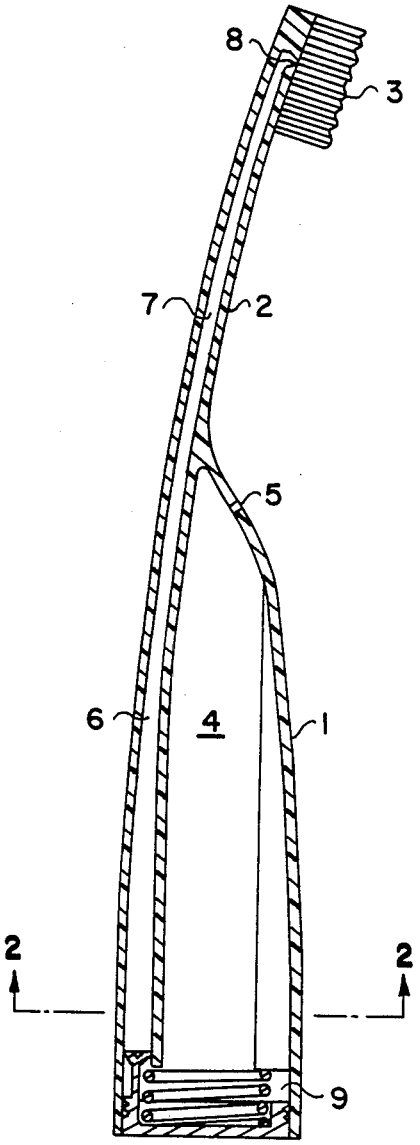
FIG. 1 shows the cross section of a first embodiment of the present invention.

The dispenser toothbrush according to FIG. 1 comprises a handle 1, one side of which is provided with a stem 2 at whose end bristles 3 are provided. A storage chamber 4 is provided inside the handle 1, in which the chamber 4 is provided with a ventilation hole 5. A duct 6 adjacent to the wall of the handle 1 connects the duct 7 in the stem 2 to an outlet opening 8 adjacent to the bristles 3.

Figure 3:
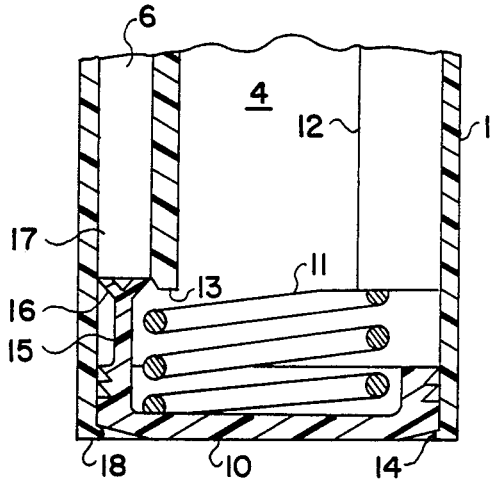
FIG. 3 is an enlarged view of the lower part of FIG. 1.

The inside of the lower part of the handle 1 forms a cylinder 9 in which a mobile piston 10, which forms an actuating element, is arranged, as shown in the enlarged detail in FIG. 3. The piston 10 is spring-biased against the direction of actuation by means of a helical spring 11, which is supported on the inside ribs 12 and against the bottom end edge 13 of the connecting duct. The piston 12 is maintained at rest by an inward projecting edge 14.

Figure 2:
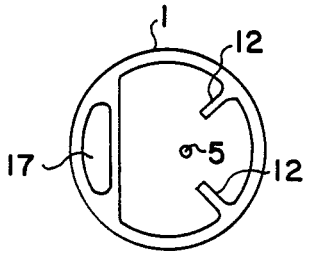
FIG. 2 is a cross section of FIG. 1.

A piston rod 15 is provided and attached at one end of the piston, whereby the end of the piston rod is provided with a lip seal 16 of elastic material. The lip seal 16 acts as a piston moving up and down in the lower end 17 of the connecting duct, which acts as a cylinder. The piston 10, the piston rod 15 and the lip seal 16 are made of a single piece of soft plastic material. FIG. 2 shows that the lower end 17 of the connecting duct 6 is of elongated, practically elliptical cross section. This provides a cross section of relatively large area that allows the lips of the lip seal 16 greater flexibility as they bend. FIG. 2 also shows that the cylinder 9 is of circular cross section adjacent to the lower part of the storage chamber.

The dispenser toothbrushes shown in FIGS. 1–3 can be simply filled after removing the piston 10, which is of relatively soft material. After filling, the piston is inserted by pressing it home past the edge 14 so that the store space 4 is sealed off by the piston 10. The piston is thereby placed in its operating position.

When the dispenser toothbrush is used, it is normally resting on the piston 10 or on the lower edge 18 of the handle 1. Thus, toothpaste is always certian to be found in the lower part of the dispenser, unless the dispenser toothbrush is empty. In order to provide toothpaste between the bristles 3 before the teeth are brushed, pressure is applied to the piston 10 so that the lip seal 16 is advanced by piston rod 15 and toothpaste is squeezed through the connecting duct 6, duct 7, the supply outlet 8 and finally between the bristles 3. Pressure is then released from the piston 10 so that the piston is retracted by the spring 11. The lip seal 16 also returns as a result. As the seal 16 returns, the lip seal will become narrower and its V shape will become more pointed, so that an area forms between the lip seal 16 and the inside walls of the lower end of the duct 6. Through this area, the toothpaste that was carried over from the storage chamber 4 on the rear side of the lip seal during the actuation stroke, can flow onto the front side of the lip seal 16. On the next actuation storke, this toothpaste that flowed past the lip seal will be squeezed forwards and this in turn will squeeze the toothpaste forward which is already in the connection duct 6 and duct 7, so that part of this toothpaste will be supplied between the bristles 3. This process can be repeated as often as required until the storage chamber 4 is completely empty, while air enters the vent hole 5. In this way, a dosing device is provided with which a certain amount of toothpaste can be supplied between the bristles 3 at each stroke by means of pressure on the piston 10. The dispenser toothbrush according to FIG. 1 includes only three parts, namely the handle 1 with its stem 2, the helical spring 11 and the piston 10 together with the piston rod 15 and the lip seal 16.

Figure 4:
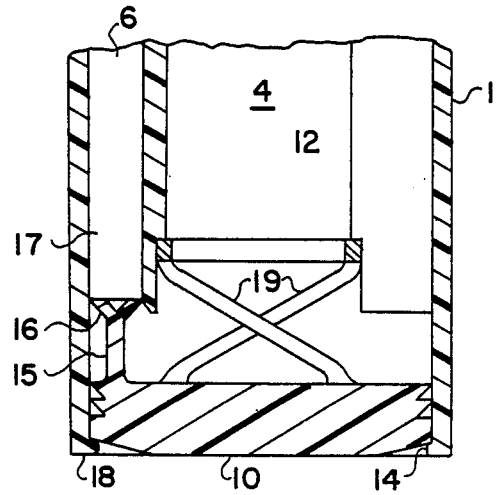
FIG. 4 shows a variant of the embodiment shown in FIG. 3.

FIG. 4 shows a variant of the lower part of the dispenser toothbrush according to FIG. 1, comprising only two components. The helical spring 11 according to FIG. 3 is replaced here by elastic arms extending outwards from the piston 10. The elastic arms are made from the same piece of material as the piston.

Figure 5:
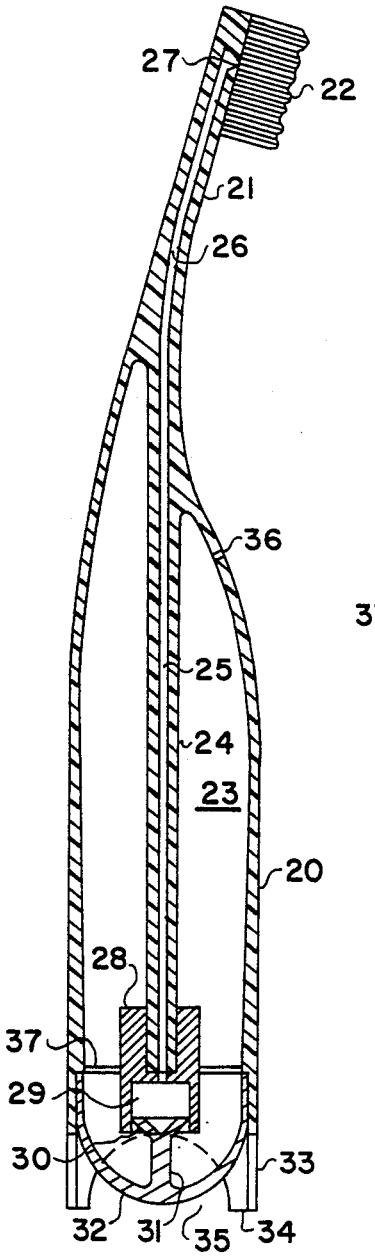
FIG. 5 shows a cross section of a second embodiment of the present invention.

FIG. 5 shows a cross section of a second embodiment of the present invention in which a handle 20 is provided with a stem 21, at the end of which bristles 22 are fitted. A storage chamber 23 is formed inside the handle 20 and a tube 24 leads through the storage chamber and is provided with an internal connecting duct 25 which is connected via a duct 26 to a supply outlet 27 adjacent to the bristles 22.

A part 28 is fastened to the lower end of the tube 24. The lower portion of part 28 forms a cylinder 29 in which a V-shaped seal 30 acts as a mobile piston. This V-shaped seal is connected to an elastic cap 32 by a piston rod 31. The lip seal 30, the piston rod 31 and the cap 32 are all made of one piece of flexible material. The lower part of the storage chamber 23 is sealed by the cap 32 and is overlapped by a tubular part 33 extending from the handle 20. The tubular part 33 serves to protect the cap 32 from being squeezed inadvertently and the lower end 34 of part 33 serves as a stand for the dispenser toothbrush. Semicircular recesses 35 are provided in the tubular part 33 to accomodate the thumb, for example, while pressure is being applied to the cap.

Figure 6:
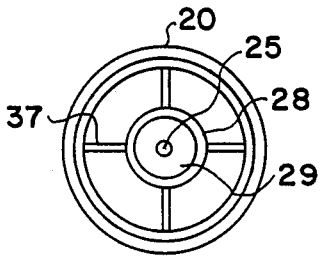
FIG. 6 shows a view from below the dispenser toothbrush according to FIG. 5, whereby the parts shown in solid black have been omitted.

The storage chamber 23 is ventilated by an air hole 36. Part 28 is provided with star-shaped bridges 37, which can be especially well seen in FIG. 6. The details of the lower part of the embodiment of the present invention according to FIG. 5 are also shown in the enlarged view of this part shown in FIG. 7.

Figure 7:
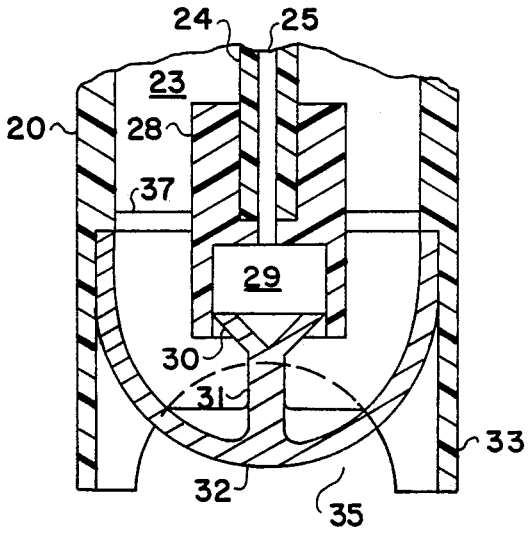
FIG. 7 shows an enlarged view of the lower part of FIG. 5.
Figure 8:
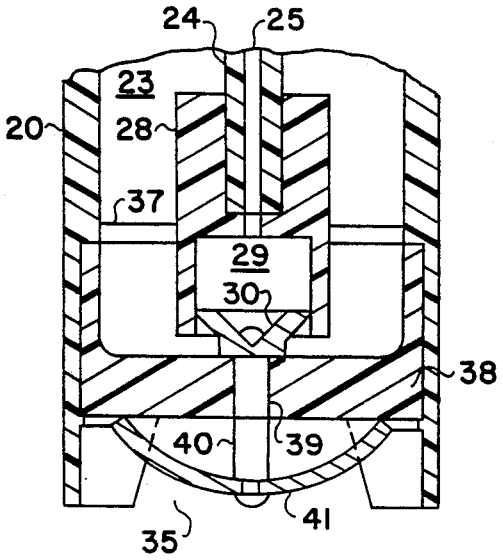
FIG. 8 shows a variant of the embodiment shown in FIG. 7.

FIG. 8 shows a variant of the lower part shown in FIG. 7. In this embodiment of the present invention, the storage chamber is sealed off by a fixed bottom plate 38 which is provided with an aperture for the passage of a piston rod 40 connecting the inner lip seal 30 with a cap 41 arranged on the outside.

Figure 9:
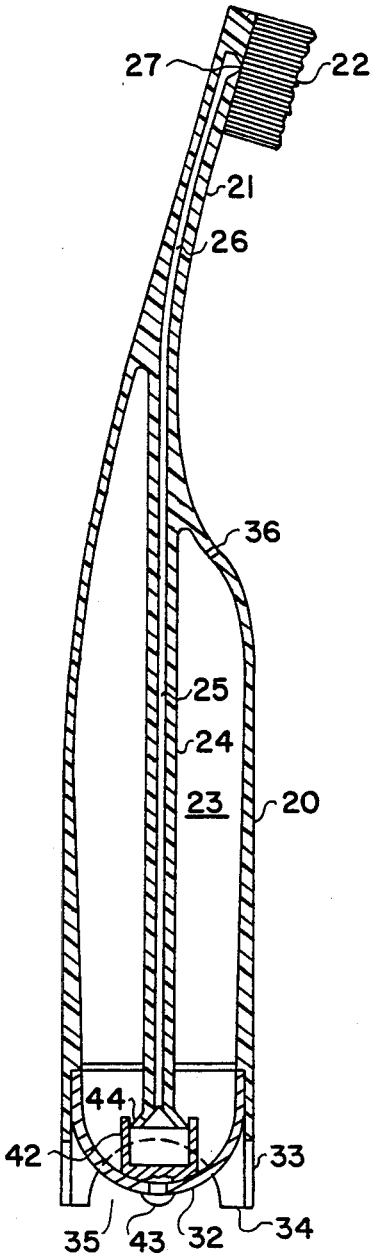
FIG. 9 shows a cross section of a third embodiment of the present invention.
Figure 10:
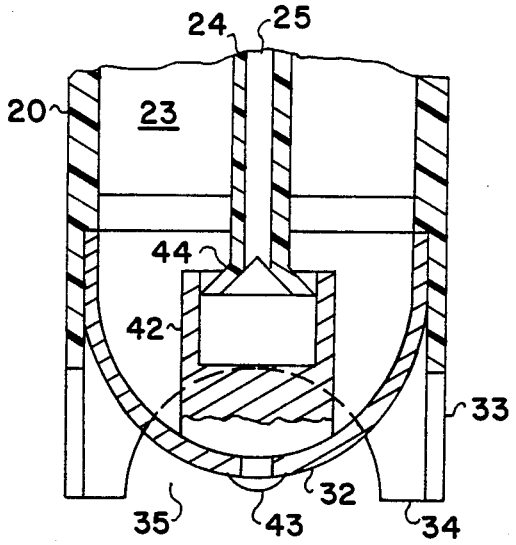
FIG. 10 shows an enlarged view of the lower part of FIG. 9.

FIG. 9 shows a further embodiment similar to that shown in FIG. 5 in which identical parts are indicated by the same reference numbers. The difference in this embodiment lies in the fact that the lip seal and the cylinder are reversed. The cap 32 is provided with a cylinder part 42 fastened by means of a stud 43. A lip seal 44 is provided at the lower end of the tube 24. FIG. 10 shows an enlarged view of the variant according to FIG. 9.

Figure 11:
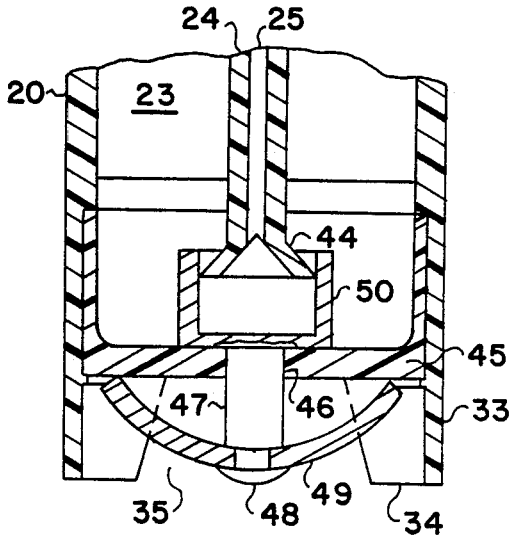
FIG. 11 shows a variant of the embodiment shown in FIG. 10.

FIG. 11 shows a variant of the embodiment of the present invention shown in FIG. 10 according to the principle illustrated in FIG. 8. In FIG. 11, the storage chamber 23 is sealed off by a fixed bottom plate 45 provided with an opening 46 for the passage of a connection rod 47 that is connected to a flexible cap 49 with a stud 48. A cylinder 50 is connected to the piston rod 47, whereby the cylinder operates together with the lip seal 44.

The present invention principally concerns a dosing device and has been described here in association with a dispenser toothbrush. However, the same basic principle could be employed in any other application requiring a simple means of dosing liquids, especially highly viscous liquids such as shoe cream, ointment, soap, food in paste form and similar products.

Figure 12:
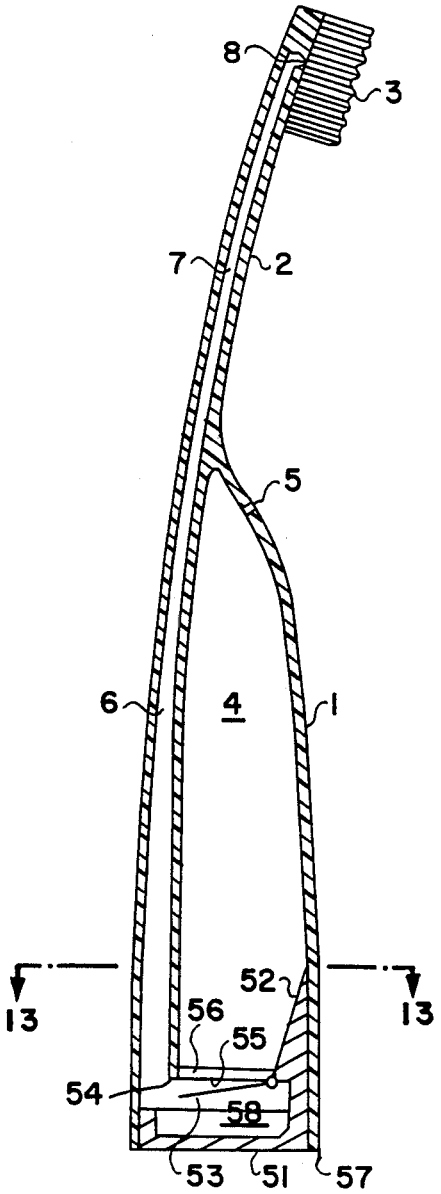
FIG. 12 shows a cross section of a fourth embodiment of the present invention.
Figure 13:
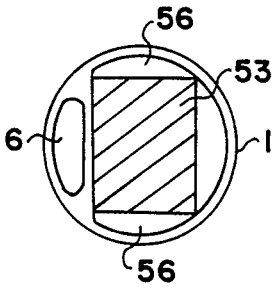
FIG. 13 shows a cross section of FIG. 12.

FIG. 12 shows a longitudinal section, similar to that shown in FIG. 1, of an embodiment of the present invention. FIG. 13 shows a cross section according to FIG. 12. In these instances the design of the handle 1 essentially resembles the handle used in the embodiments according to FIG. 1. Similar or identical parts are given the same reference numbers in all cases. A cap is firmly inserted in the lower part of the handle 1 and is provided with an extension 52 which partially extends into the storage chamber 4. The extension 52 is provided with a freely hinged flap 53, which consists of one unitary piece together with the cap 51 and the extension 52. In its closed condition the flap 53 is large enough to extend right up to the lower edge 54 and the lower faces 55 of the lateral projections 56 of the storage chamber 4. The lower edge of the handle 1, together with the essentially smooth cap 51, provide a smooth supporting surface on which the dispenser toothbrush can be stood upright.

FIG. 13 shows a cross section according to FIG. 12, in which the location of the extension 52 and of the lateral projections 56 can be clearly seen. The flap 53 is indicated by cross-hatching so that the passage through the valve formed in this way between the extension 52, the projections 56 and the lower edge 54 can be clearly recognized.

In use, the dispenser toothbrushes shown in FIG. 12 and 13 are normally stood up on their edge 57. The cleaning agent, such as toothpaste, contained in the storage chamber 4 will thus naturally fall under the effect of gravity down and past the open valve flap 53 into the space 58. By the application of pressure to the diaphragm-like part of the cap 51, the volume of the chamber 58 can be reduced. As a result, the valve flap 53 will close and come to bear right up against the edge 54 and the lower surfaces 55. In this way, the toothpaste can only escape through the connecting duct 6, so that it will emerge at the outlet hole 8. As soon as pressure is removed again fro the diaphragm of the cap 51, the cap will try to return to its normal position, so that the volume of the space 58 increases again. Because of the flow resistance in the duct 6 and also in the outlet opening 8, no toothpaste, or only a minute quantity, will flow back into the space 58. Instead, on account of the practically nonexistent flow resistance, the toothpaste will flow back past the valve flap 53 into the space 58. A further quantity of toothpaste can be pumped from the outlet 8 into the area of the bristles 3 by again squeezing the cap 51.

Figure 14:
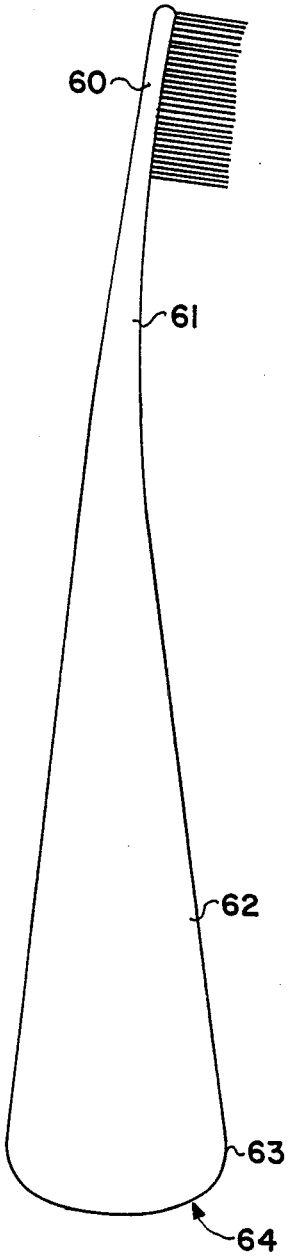
FIG. 14 shows a side view of an embodiment of the present invention.

The toothbrush shown in FIG. 14 is provided with a brush part 60, a stem 61 and a handle 62. The cross section of the handle 62 and the stem 61 diminishes from the end 63 remote fromt he brush part 60 towards the brush part 60 in an essentially regular way, so that the handle 62 and the stem 61 form a unitary structure that narrows as it approaches the brush part 60. The stem 61 is slightly bent so that the handle 62 and the brush part 60 will conform to the position of the hand when the teeth are brushed and the brush part 61 is positioned in the desired direction. The end 63 of the handle 62 is also provided with a supporting surface 64 on which the entire toothbrush can be stood. A storage chamber for toothpaste can be provided most preferably adjacen to the wide cross section area of the handle 62, thus turning this toothbrush into a dispenser toothbrush. Adjacent to the end 63 of the handle 62 a toothpaste supply arrangement may also be provided. Since the cross section of the handle 62 is large, at least adjacent to the part remote from the brush part, it can be comfortably and firmly held in the hand. Since the handle 62 narrows as it approaches the brush, unnecessary wide cross sections are avoided, thus allowing the toothbrush to be introduced as deeply into the mouth as necessary.

Figure 15:
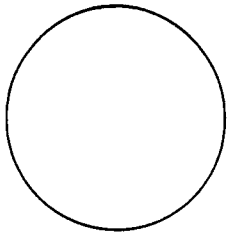
FIG. 15 shows the largest cross section of the handle of the dispenser toothbrush according to FIG. 14.

FIG. 15 shows a cross section of the handle 62 adjacent to the end 63 and also the shape of the stand support surfade 64. FIG. 15 corresponds to FIG. 16 and shows the octagonal cross section of the handle 62 which may also include the stem 61.

Figure 16:
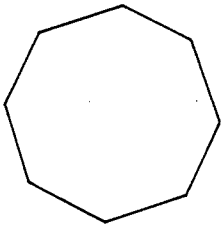
FIG. 16 shows an octagonal section corresponding to FIG. 15.
Figure 17:
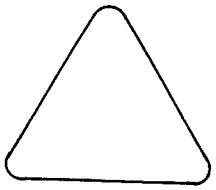
FIG. 17 shows a triangular section corresponding to FIG. 15.

FIG. 17 shows a special case of the triangular cross section according to FIG. 16, which provides a dispenser toothbrush of somewhat reduced internal volume but whose handle 62 can be very firmly gripped in the hand.

Figure 18:
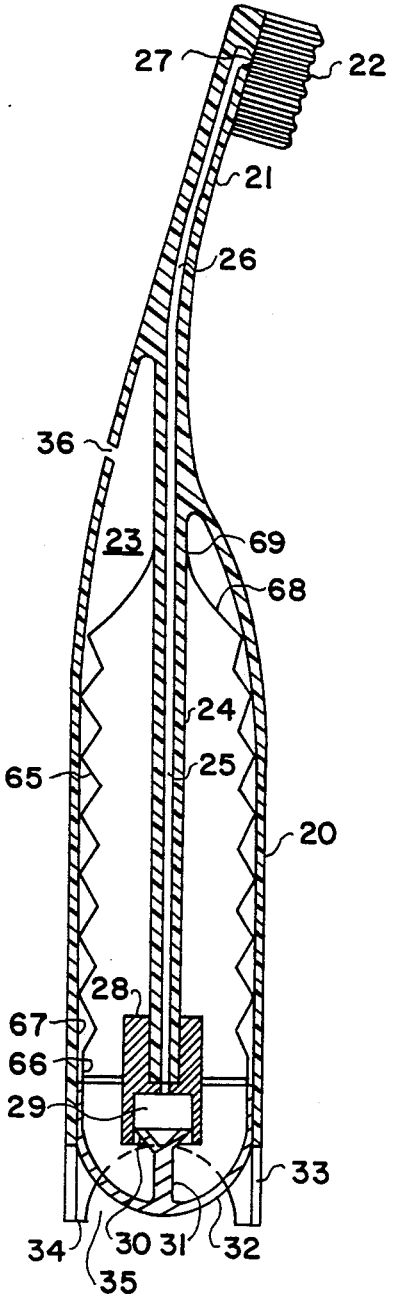
FIG. 18 shows a variant of FIG. 5 provided with a bellows.

FIG. 18 shows a variant of an embodiment according to FIG. 5. Identical parts are provided with the same reference numbers in both cases. An essentially cylindrical bellows 65 with zigzag shaped walls is provided in the chamber 4. The lower edge 66 of the bellows is firmly gripped between the inside wall 67 of the handle 20 and the outside wall of the flexible cap 32. The uppre end of the bellows 65 is provided with a truncated conic part 68 that forms an aperture. The edge of the conic part 68 forms a cylindrical lip 69 that closely surrounds the tube 24. The tube 24 however, can continue to slide within this lip 69. The interior of the bellows 65 forms a storage chamber for toothpaste which is protected by the bellows 65 against drying out or the ingress of air, whereby the toothpaste is prevented from escaping from the bellows or through the air hole 36. As the bellows is emptied, it simply contracts, whereby the lip 69 slides over the tube 24.

The present invention has been described in terms of certain preferred embodiments. Numerous other embodiments, however, may fall within the spirit and scope of the present invention and the following claims.

I hereby claim:

1. A dispenser toothbrush comprising a handle containing a storage chamber for toothpaste, one end of the handle being provided with a stem through which a duct leads from the storage chamber to a dispenser adjacent to a brush arranged at the free end of the stem remote from the storage chamber, a valve capable of closing off the storage chamber from the duct, and an actuating device provided at the other end of the handle which serves to actuate a means for altering the volume between the valve and the dispenser, the means being located between the storage chamber and the duct, the means and the valve being cooperatively arranged at said other end of the handle such that the valve closes only when the means is actuated, the duct running substantially the entire length of the dispenser toothbrush and being of sufficient narrowness such that the resistance to the flow of toothpast in the duct substantially prevents the flow of toothpaste from the dispenser to the storage chamber.

2. A dispenser toothbrush according to claim 1, wherein the valve is arranged between the storage chamber and the duct the other end of the handle forming a stand on which the dispenser toothbrush can be vertically stood with its stem pointing upwards, the valve being unbiased in the direction in which it closes and the direction in which the valve closes being upwards when the dispenser toothbrush is vertically stood with its stem pointing upwards.

3. A dispenser toothbrush according to claim 1, wherein the means for altering the volume comprises a piston and a cylinder, the valve being formed by one end of the piston, said one end comprising an elastic lip seal of V-shaped cross section communicating with the cylinder, the side of the lip seal forming the V being positioned to face the supply outlet of the duct, and the other side of the lip seal being in communication with the toothpaste storage chamber.

4. A dispenser toothbrush according to claim 3, wherein the piston comprises the V-shaped seal and a piston rod, the piston rod extending from the tip of the V to the actuating device.

5. A dispenser toothbrush according to claim 4, wherein the lip seal and the piston rod are made from a single piece of plastic material.

6. A dispenser toothbrush according to claim 4, wherein the actuating device, the lip seal, and the piston rod are made from a single pice of plastic material.

7. A dispenser toothbrush according to claim 1, wherein the actuating device comprises a piston that seals off a cylindrical opening to the storage chamber, the piston being spring-biased outwards against the direction of actuation.

8. A dispenser toothbrush according to claim 7, wherein the spring is a helical spring.

9. A dispenser toothbrush according to claim 7, wherein the spring is formed of elastic arms extending out from the piston.

10. A dispenser toothbrush according to claim 9, wherein the elastic arms and the piston are made from a single piece of plastic material.

11. A dispenser toothbrush according to claim 1, wherein the means for altering the volume and the actuating device comprise a plastic cap.

12. A dispenser toothbrush according to claim 11, wherein the storage chamber is sealed off by the cap.

13. A dispenser toothbrush according to claim 11, wherein the cap has a convex outside shape that is essentially ball shaped.

14. A dispenser toothbrush according to claim 13, wherein the cap, the piston rod and the lip seal are made from a single piece of plastic material.

15. A dispenser toothbrush according to claim 14, wherein the cap is arranged outside a fixed plate that seals off the storage chamber, the plate having a guide opening for the piston rod.

16. A dispenser toothbrush according to claim 7, wherein at least a portion of the handle projects beyond the actuating device.

17. A dispenser toothbrush according to claim 16, wherein the projecting portion of the handle forms an essentially tubular extension of the handle and is provided with at least one recess suitably sized and shaped for insertion of a finger.

18. A dispenser toothbrush according to claim 3, wherein an extension duct is provided adjacent to the wall of the handle to connect the duct in the stem with the piston and the cylinder.

19. A dispenser toothbrush according to claim 18, wherein one end of the connecting duct forms the cylinder.

20. A dispenser toothbrush according to claim 3, wherein a connection tube is arranged in the storage chamber to connect the duct in the stem with the piston and the cylinder.

21. A dispenser toothbrush according to claim 20, wherein one end of the connecting tube forms the cylinder.

22. A dispenser toothbrush according to claim 20, wherein the cylinder is mounted on one end of the connecting tube.

23. A dispenser toothbrush according to claim 20, wherein one end of the connecting tube is provided with the lip seal, the cylinder being arranged on the actuating device.

24. A dispenser toothbrush according to claim 4, wherein the distance between the lip seal and the inner wall of the cylinder is such that when the actuating device is operated, the lip seal is stretched by the piston rod as far as the inner wall of the cylinder.

25. A dispenser toothbrush according to claim 1, wherein the storage chamber is provided with a ventilation opening.

26. A dispenser toothbrush according to claim 3, wherein the duct is provided with a narrowed portion.

27. A dispenser toothbrush according to claim 3, wherein the lip seal is symmetrical or takes the form of a tapered ellipse.

28. A dispenser toothbrush according to the claim 11, wherein the valve is provided with a flap, disk or similar device that serves to close off the storage chamber from the duct.

29. A dispenser toothbrush according to claim 28, wherein the flap, disk or similar device and the cap are made from a single piece of plastic material 30. A dispenser toothbrush according to claim 28, wherein the flap, disk or similar device extends essentially over the entire cross section of the lower portion of the storage chamber.

31. A dispenser toothbrush according to claim 1, wherein the perimeter of the cross section of the handle generally increases as it recedes from the stem.

32. A dispenser toothbrush according to claim 1, wherein the cross section of the stem essentially diminishes as it approaches the brush.

33. A dispenser toothbrush according to claim 32, wherein the cross section of the handle and the of the stem essentially diminishes from the remote end of the handle towards the brush such that the handle and the stem form a unitary structure that narrows as it approaches the brush.

34. A dispenser toothbrush according to claim 31, wherein the handle or the stem is bent.

35. A dispenser toothbrush according to claim 31, wherein the cross section of the handle or the stem is round, oval, triangular or polygonal.

36. A dispenser toothbrush according to claim 31, wherein the remote end of the handle is shaped to serve as a stand for the toothbrush.

37. A dispenser toothbrush according to claim 31, wherein the storage chamber for toothpaste is provided in the handle and a supply duct is provided in the stem.

38. A dispenser toothbrush according to claim 37, wherein an arrangement for the supply of toothpast is provided in the end of the handle remote from the brush.

39. A dispenser toothbrush according to claim 1, wherein an envelope having an opening and whose volume can be easily changed is located in the storage chamber, the edge of the envelope being connected to an inside wall of the chamber, the chamber being provided with an opening to the outside for ventilation purposes.

40. A dispenser toothbrush according to claim 39, wherein the envelope comprises a bellows.

41. A dispenser toothbrush according to claim 40, wherein the lower edge of the bellows is firmly retained between the inside wall of the handle and the means for altering the volume of the storage chamber, thereby comprising a means for changing the volume of the bellows.

42. A dispenser toothbrush according to claim 40, wherein the end of the bellows positioned towards the stem is closed, except for an opening whose edge forms a cylindrical lip that surrounds the duct.

43. A dispenser toothbrush according to claim 42, wherein the end of the bellows remote from the means for altering the volume of the dispenser is provided with a truncated conic shaped portion.

44. A dispenser toothbrush according to claim 40, wherein essentially the entire length of the bellows bears on and can easily move along the inside wall of the handle.

45. A dispenser toothbrush according to claim 42, wherein the cross section of the bellows varies along its length to correspond with the cross section of the storage chamber.

* * * * *